US006201163B1

(12) United States Patent
Morris et al.

(10) Patent No.: US 6,201,163 B1
(45) Date of Patent: Mar. 13, 2001

(54) PIPELINE TRANSMISSION METHOD

(75) Inventors: Ian Morris, Vancouver; Glen Perry, Calgary, both of (CA)

(73) Assignee: JL Energy Transportation Inc., Calgary (CA)

( * ) Notice: Subject to any disclaimer, the term of this patent is extended or adjusted under 35 U.S.C. 154(b) by 0 days.

(21) Appl. No.: 08/895,583

(22) Filed: Jul. 16, 1997

Related U.S. Application Data

(63) Continuation-in-part of application No. PCT/CA96/00749, filed on Nov. 18, 1996, which is a continuation-in-part of application No. 08/560,402, filed on Nov. 17, 1995, now abandoned.

(30) Foreign Application Priority Data

May 16, 1997 (CA) ..... 2205670

(51) Int. Cl.[7] ..... F17D 1/02
(52) U.S. Cl. ..... 585/899; 137/13
(58) Field of Search ..... 137/13; 585/899

(56) References Cited

U.S. PATENT DOCUMENTS

| | | | | |
|---|---|---|---|---|
| 2,958,205 | | 11/1960 | McConkey . | |
| 3,071,452 | | 1/1963 | Braconier et al. . | |
| 3,232,725 | | 2/1966 | Second et al. . | |
| 3,298,805 | | 1/1967 | Second et al. . | |
| 3,407,613 | | 10/1968 | Muller et al. . | |
| 3,574,276 | | 4/1971 | Strelzoff . | |
| 3,906,972 | * | 9/1975 | Jensen et al. | 137/13 |
| 3,990,256 | * | 11/1976 | May et al. | 62/53 |
| 4,010,622 | * | 3/1977 | Etter | 62/48 |
| 4,024,720 | * | 5/1977 | Dimentberg et al. | 62/55 |
| 4,139,019 | | 2/1979 | Bresie et al. . | |
| 4,958,653 | | 9/1990 | Lowther . | |
| 5,020,561 | | 6/1991 | Li . | |
| 5,230,938 | | 7/1993 | Hess et al. . | |
| 5,315,054 | | 5/1994 | Teel . | |

FOREIGN PATENT DOCUMENTS

| | | |
|---|---|---|
| 2235140 | 5/1997 | (CA) . |
| 1415729 | 11/1975 | (GB) . |
| WO97/19151A | 5/1997 | (WO) . |

OTHER PUBLICATIONS

Engineering DataBook, 10th Edition, vol. 1, Sections 13, 17 & 23, Gas Processors Association (1987)–no month.

Peng, D. & Robinson, D.B, "A New Two–Constant Equation of State", Ind. Eng. Chem. Fundamentals (1976) p. 59–no month.

Van Velzen, D., Carbozo, R.L., & Langenkamp, H. "A Liquid Viscosity–Temperature–Chemical Constitution Relation for Organic Compounds" Ind. Eng. Chem. Fundamentals No Month (1972)p. 20.

Dean, D.E. & Stiel, L.I. "The Viscosity of Non Polar Gas Mixtures at Moderate & High Pressures", AIChE Journal, (May 1965) p. 256.

Eaton, B.A., Andrews, D.E., Knowles, C.R., Silberberg, I.K., & Brown, K.E. The Prediction of Flow Patterns, Liquid Hold–Up and Pressure Losses Occurring During Continuous Two–Phase Flow in Horizontal Pipelines, Journal of Petrol. Tech. (Jun. 1967) p. 815.

Taitel, Y. & Dukler, A "A Model for Predicting Flow Regime Transitions in Horizontal & Near Horizontal Gas–Liquid Flow", AIChE Journal (Jan. 1976) p. 47.

Oliemans, R.V.A., "Two Phase Flow–In Gas–Transmission Pipelines" paper, Joint Petroleum Mech. Eng. & Pressure Vessels & Piping Conf., Mexico City, Mexico (Sep. 1976) p. 1.

Connell, D.E. Horth, P and Powell, R.H.W. "Analysis Sets Optimum $C_3$ Recovery for North Sea Gas Terminal" Oil & Gas Journal, Oct. 4, 1993 p. 74.

Stripling, T.E., Khan, A.U. and Dillon, K. "Hydraulic Analysis Aids High Pressure System Design Technology", Jan. 28, 1985, Oil & Gas Journal p. 125.

King, G. "Ultra–High Gas Pressure Pipelines Offer Advantages for Artic Service" Oil & Gas Journal Jun. 1, 1992 p. 79.

Author Unknown, "What Mobil Has Learned in Phase B at St. Fergus" Oil & Gas Journal, Sep. 5, 1994 p. 100.

* cited by examiner

*Primary Examiner*—Walter D. Griffin
*Assistant Examiner*—Nadine Preisch
(74) *Attorney, Agent, or Firm*—Blake, Cassels & Graydon LLP; George E. Fisk

(57) ABSTRACT

At pressures over 1,000 psia, it is advantageous to add to natural gas an additive which is a $C_2$ or $C_3$ hydrocarbon compound or a mixture of such compounds. Above a lower limit (which varies with the additive being added and the pressure), this results in a decrease in the amount of power needed to pump the mixture or to compress it.

7 Claims, 7 Drawing Sheets

| FLOW RATIOS FROM Mw & Z VALUES | | | | | | |
|---|---|---|---|---|---|---|
| | | Mw | Z@ 30°F | Z@ 60°F | $\frac{1}{\sqrt{(Mw.Z)}}$ @ 30°F (% Change from Base Case) | $\frac{1}{\sqrt{(Mw.Z)}}$ @ 60°F (% Change from Base Case) |
| Gas 100% C1 BaseCases | at 1100 psia | 16.04 | 0.817 | 0.856 | 0.2763 (0.00%) | 0.26699 (0.00%) |
| Gas 90% C1 10% C2 | at 1100 psia | 17.45 | 0.769 | 0.819 | 0.2730 (-1.19%) | 0.2645 (-2.00%) |
| Gas 80% C1 20% C2 | at 1100 psia | 18.85 | 0.711 | 0.775 | 0.2732 (-1.12%) | 0.2616 (-3.08%) |
| Gas 70% C1 30% C2 | at 1100 psia | 20.25 | 0.638 | 0.722 | 0.2782 (+0.69%) | 0.2615 (-3.30%) |

| | | Mw | Z@ 30°F | Z@ 60°F | $\frac{1}{\sqrt{(Mw.Z)}}$ @ 30°F (% Change from Base Case) | $\frac{1}{\sqrt{(Mw.Z)}}$ @ 60°F (% Change from Base Case) |
|---|---|---|---|---|---|---|
| Gas 100% C1 | at 1900 psia | 16.04 | 0.742 | 0.798 | 0.2899 (+4.92%) | 0.2795 (+3.37%) |
| Gas 90% C1 10% C2 | at 1900 psia | 17.45 | 0.681 | 0.746 | 0.2901 (+4.99%) | 0.2772 (+2.70%) |
| Gas 80% C1 20% C2 | at 1900 psia | 18.85 | 0.616 | 0.689 | 0.2935 (+6.23%) | 0.2775 (+2.82%) |
| Gas 70% C1 30% C2 | at 1900 psia | 20.25 | 0.553 | 0.628 | 0.2988 (+8.14%) | 0.2804 (+3.89%) |

FIG. 1F

SUMMARY OF PIPELINE HORSEPOWER
REQUIREMENTS FOR GAS MIXES

PIPELINE DIAMETER: 36"
MAX.OPERATION PRESSURE: 1740 psia

INLET TEMPERATURE: 80° F
GROUND TEMPERATURE: 32° F

| THRUPUT MMSCF/D | TYPICAL TRANSMISSION GAS 2 % $C_2$ | ENHANCED GAS 6 % $C_2$ | ENHANCED GAS 14 % $C_2$ | ENHANCED GAS 35 % $C_2$ |
|---|---|---|---|---|
| 500 | 10 549 | 10 235 | 9857 | 7724 |
| 1000 | 92 018 | 89 705 | 87 157 | 75 071 |
| 1500 | 343 621 | 330 406 | 315 833 | 271 784 |
| 2000 | 812 579 | 760 244 | 714 199 | 651 860 |
| 2300 | 1 480 446 * | * * | * * | * * |
| 2500 | ** | 1 784 791 | 1 387 893 | 1 209 985 |

* APPROACHING PRACTICAL LIMITS
** BEYOND PRACTICAL LIMITS

FIG. 3

PIPELINE TRANSMISSION METHOD

CONTINUING APPLICATION DATA

This application is a continuation-in-part of international PCT application PCT/CA96/00749 filed Nov. 18, 1996 (which designates the USA), which is in turn a continuation-in-part of U.S. application Ser. No. 08/560,402 filed Nov. 17, 1995 (now abandoned). Convention Priority for the subject matter of this application not contained in the International PCT Application PCT/CA96/00749 is claimed from Canadian Patent Application 2,205,670, filed May 16, 1997, and issued as Canadian Patent 2,206,670 on Nov. 16, 1999.

FIELD OF THE INVENTION

This invention relates to the transfer by pipeline of mixtures which contain methane or natural gas.

BACKGROUND OF THE INVENTION

As is well known, methane is the largest component of natural gas, and usually accounts for at least 95% by volume of what is known as "transmission specification" natural gas. Other usual components are ethane (usually about 2%), propane (usually about 0.5%), butanes, pentanes and possibly hexanes (altogether amounting to less than about 0.3%), with the balance being nitrogen and carbon dioxide. In this disclosure, transmission specification natural gas will be hereinafter called "natural gas". For example, the natural gas as transmitted through the pipelines of TransCanada Pipeline Limited from Alberta, Canada to Ontario, Canada has typically the following percentage composition by volume:

| Component | Feed |
|---|---|
| Nitrogen | 0.01270 |
| Carbon Dioxide | 0.00550 |
| Methane | 0.95400 |
| Ethane | 0.01970 |
| Propane | 0.00510 |
| i-Butane | 0.00170 |
| n-Butane | 0.00080 |
| i-Pentane | 0.00020 |
| n-Pentane | 0.00010 |
| n-Hexane | 0.00020 |

The relation between pressure, volume and temperature of a gas can be expressed by the Ideal Gas Law, which is stated as PV=nRT, where:

P=pressure of gas

V=volume of gas n=number of moles of the gas

R=the universal gas constant (which, as is known, varies somewhat depending on volume and temperature)

T=temperature of the gas.

If the equation is expressed in English units, the pressure is in pounds per square inch absolute (psia), the volume is in cubic feet, and temperature is in degrees R (degrees Fahrenheit plus 460).

The Ideal Gas Equation does not give exactly correct results in actual practice, because gases are compressible. Gas molecules, when compressed, pack more tightly together than would be predicted by the Ideal Gas Equation, because of intermolecular forces and molecular shape. To correct for this, an added term, the compressibility factor z, can be added to the Ideal Gas Equation. This is a dimensionless factor which reflects the compressibility of the particular gas being measured, at the particular temperature and pressure conditions.

At atmospheric pressure or gage pressures of a few hundred pounds, the compressibility factor is sufficiently close to 1.0 so that it can be ignored for most gases, and so that the Ideal Gas Law can be used without the added term z. However, where pressures of more than a few hundred pounds exist, the z term can be different enough from 1.0 so that it must be included in order for the Ideal Gas Equation to give correct results.

According to the van der Waals theorem, the deviation of a natural gas from the Ideal Gas Law depends on how far the gas is from its critical temperature and critical pressure. Thus, the terms $T_R$ and $P_R$ (known as reduced temperature and reduced pressure respectively) have been defined, where $$T_R = \frac{T}{T_c}$$

$$P_R = \underline{P}$$

where,

T=the temperature of the gas in degrees R $T_c$=the critical temperature of the gas in degrees R P=the pressure of the gas in psia $P_c$=the critical pressure of the gas in psia Critical pressures and critical temperatures for pure gases have been calculated, and are available in most handbooks. Where a mixture of gases of known composition is available, a pseudo critical temperature and pseudo critical pressure which apply to the mixture can be obtained by using the averages of the critical temperatures and critical pressures of the pure gases in the mixture, weighted according the percentage of each pure gas present.

Once a pseudo reduced temperature and pseudo reduced pressure are known, the compressibility factor z can be found by use of standard charts. One of these is "Compressibility Factors for Natural Gases" by M.D. Standing and D. L. Katz, published in the *Engineering Data Book,* Gas Processors Suppliers Association, 10th edition (Tulsa, Oklahoma, U.S.A.) 1987.

When the compressibility factor z of methane is read from the charts, it is found that the factor z is always less than 1.0 in normal temperature ranges (i.e. between about −40° F. and 120° F.) and that it decreases as the pressure rises or the temperature falls. Therefore, less energy need be used to pump a given volume of methane (measured at standard volume) at any given normal temperature than would be expected at that temperature if the methane were an ideal gas. This effect is more marked at higher pressures. Similarly, as the pressure is increased at a constant temperature, more methane (measured at standard volume) can be stored in a given volume than would be predicted from the Ideal Gas Equation. "Standard volume" is volume measured at standard pressure and temperature (STP)).

Natural gas, like methane, shows z factor changes with pressure. Under about 1000 psia the dominant variable in the power relationship is the molecular weight of the gas. At this pressure level, addition of further amounts of ethane or propane increases the molecular weight of the gas more rapidly than the z factor decreases. Thus, there is an advantage to removing ethane and propane from the gas.

It is usual in the gas transportation and storage industry to try to strip out higher hydrocarbons such as ethane, propane, butane and unsaturated hydrocarbons from natural gas if the gas is to be transmitted through pipelines. This leaves mostly methane (with some traces of nitrogen and carbon dioxide)

to be transported by the gas pipeline. The materials which are stripped out are then transported or stored separately, often as liquids.

SUMMARY OF THE INVENTION

It has now been found that, at pressures over 1,000 psia, it is advantageous to add to natural gas an additive which is a $C_2$ or $C_3$ hydrocarbon compound or a mixture of such additives. Above a lower limit (which varies with the additive being added and the pressure), this results in a smaller product of the z factor times the average molecular weight of the gas (hereinafter called the $zM_w$ product) than would exist with methane alone, therefore leading to a decrease in the amount of power needed to pump the mixture or to compress it.

DETAILED DESCRIPTION OF THE INVENTION

If ethane is the additive, enough ethane must be added to methane or natural gas to give a gas composition having a minimum of about 26% ethane for operation at 1,000 psia and normal temperatures (−40° F. to +110° F.). (All percentages in this document are percentages by volume). Ethane can be added until just before the mixture separates into separate gas and liquid (which occurs at about 40% ethane for a pressure 1,000 psia and a temperature of about 35° F.). To reduce the danger of liquefaction if there is inadvertent pressure drop, and to reduce temperature extremes, generally operation at 26–35% ethane and 35° F. to +40° F. is preferred.

When the pressure is raised to 2,200 psia, the addition of enough ethane to natural gas to give a gas composition having more than 6% ethane gives some beneficial results. Thus, as pressure increases, in the range from 1,000 psia to about 2,200 psia the beneficial results occur with less and less ethane. For the most beneficial results, however, an addition of enough ethane to give at least 15% ethane is preferred at pressures of 2,200 psia.

Thus, for ethane as an additive, an amount is added to give a gas which has at least 26% ethane (but preferably 35% ethane) at 1,000 psia, and at least 6% ethane (but preferably 15% ethane) at 2,200 psia, with the minimum percentage of ethane decreasing smoothly with rise in pressure. Ethylene may be substituted for all or part of the ethane on a 1:1 volume basis. Where pressure fluctuates, as in a gas pipeline where the gas is compressed at compressor stations and becomes less compressed as it flows between compressor stations, the pressure indicated is the maximum pressure to which the gas is compressed. In such a compression-rarefaction arrangement, it is preferred that the ratio between the most compressed and the most rarefied pressures of the gas not exceed 1.3:1.

$C_3$ hydrocarbons alone can also be used as the additive. Minimum useable percentage of the total gas mixture vary from a minimum of 5% at 1,000 psia to about 3% at 2,200 psia. Maximum amounts are those which will not cause separation of a liquid phase at the temperature used. The $C_3$ hydrocarbons may be any of propane, isopropane or propylene, separately or in admixture.

One or more $C_3$ hydrocarbons may also be substituted, preferably on a 1:3.5 volume basis, for $C_2$ hydrocarbons, but not to a point where they cause separation of a liquid phase at the pressure and temperature of operation. (A 1:3.5 basis means that each standard volume of $C_3$ hydrocarbon replaces three and a half standard volumes of $C_2$ hydrocarbon.) Generally, the limitation that a liquid phase should not be formed means that not more than about 12% of $C_3$ hydrocarbons should be present at 1000 psia and 60° F., and lesser amounts should be used as the pressure or temperature increases.

Two or more of the $C_2$ or $C_3$ additives can also be used. The use of two or more additives has a synergistic effect in many cases, so that less than the minimum amount of each is needed than would be needed if only one were present, in order to produce a $zM_w$ product smaller than that of an equivalent standard volume of natural gas at the pressure and temperature involved.

At pressures over 1000 psig, $C_4$ hydrocarbons do not contribute much to the improvement of the $zM_w$ product. Thus $C_4$ hydrocarbons are not additives contemplated by this invention. However $C_4$ hydrocarbons which are already present in the natural gas need not be removed if they are present in insufficient quantity to liquify or to affect the $zM_w$ product very adversely. The presence of more than 1% $C_4$ hydrocarbon in the mixture is not preferred, however, as $C_4$ hydrocarbons tend to liquify easily at pressures between 1,000 psia and 2,200 psia, and more than 1% $C_4$ hydrocarbons give rise to increased danger that a liquid phase will separate out. $C_4$ hydrocarbons also have an unfavourable effect on the mixture's z factor at pressures just under 900 psia, so care should be taken that, during transport through a pipeline, that mixtures according to the invention which contain $C_4$ hydrocarbons are not allowed to decompress to less than 900 psia, and preferably not to less than 1,000 psia.

The addition of amounts of additive below the lower limit (unless two additives with a synergistic effect are used) actually increase the $zM_w$ product over that of methane or natural gas alone, and is thus detrimental. For example, when the pressure is 1,000 psia and the temperature is 35° F., mixtures of methane and ethane having less than about 26% ethane have a z factor greater than methane alone (all percentages are based on volumes at standard pressures and temperatures). Adding ethane to increase the percentage of ethane from 2% to, for example 12% at this pressure and temperature is therefore counterproductive, as it increases the $zM_w$ product and therefore increases the energy required to pump or compress for storage a given standard volume of gas. However, when more than 26% of ethane is present, the z factor falls so much that the $zM_w$ product tends to lower values than that of pure methane. The z factor continues to get smaller with increased percentages of ethane, bringing with it a lower $zM_w$ product to the point where further increase of ethane causes separation of a liquid phase (at about 40% ethane at 1,000 psia and 35° F.). Thus, adding ethane to natural gas so that there is a mixture containing more than 26% ethane at 1,000 psia and 35° F. leads to increased packing of molecules and a decreased $zM_w$ product, hence decreased pumping costs and more ability to store within a given volume. At 1,350 psia and 85° F., improved results over methane alone are obtained when only 17% of ethane is present in the mixture. Where the pressure is increased to 1,675 psia at 35° F., mixtures with 13% or more ethane, and the balance methane give improved results over methane alone. At 2,140 psia and 35° F., the improved effect is shown in mixtures of 6% ethane and the balance methane.

By the avoidance of liquid phase in this disclosure is meant the avoidance of enough liquid to provide a coherent liquid phase in the pipeline at the temperatures and pressures used. Such a phase can create pipeline problems through pooling in low portions of the pipeline or forming liquid slugs which affect pumping efficiency. A few liquid droplets in the line however, can be tolerated.

The use of a hydrocarbon as additive has the additional advantage that it permits transport of a mixture of methane or natural gas and the hydrocarbon additive in a single pipeline with less energy expenditure than if the two were transported separately in separate pipelines.

BRIEF DESCRIPTION OF THE DRAWINGS

The invention will be described further in association with the following drawings in which:

FIG. 1F shows calculations of flow ratios for various mixtures of methane and ethane.

FIG. 3 is a summary of pipeline horsepower requirements for various gas mixes, using a 36" pipeline operating at a maximum operation pressure of 1,740 psia, an inlet temperature of 80° F. and a ground temperature of 32° F.

DETAILED DESCRIPTION OF THE EMBODIMENTS SHOWN IN THE DRAWINGS

Dealing first with FIG. 1, this shows, for various pressures and the same temperature, the effect of the addition of ethane to methane. In each case, the z factor has been calculated for each percentage of ethane from 0 to 40%. Then, the lowest calculated z factor has been arbitrarily defined as 0% capacity gain. Each of the other results has been plotted as a percentage capacity gain with reference to the 0% capacity gain in order to prepare a curve. Curves developed in this way are given in FIGS. 1A to 1E, for different pressures, with each curve representing the situation for one pressure. The temperature represented by each curve is 35° F.

Figure 1A:
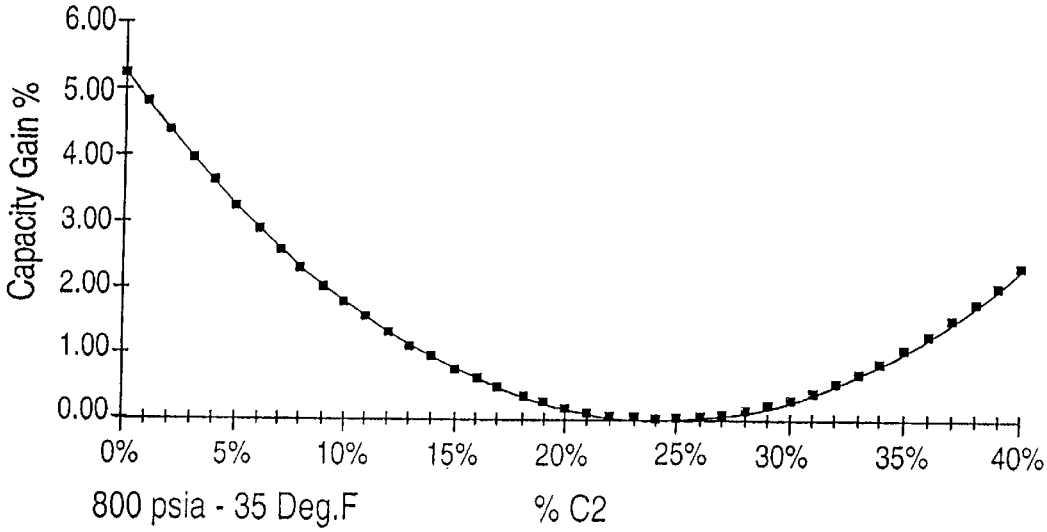
FIGS. 1A to 1E are plots of capacity gain in percent against the content of $C_2$ hydrocarbons in a mixture of methane and ethane. Each of the plots shows the results at a different pressure.

Looking at FIG. 1A, it is seen that, for an 800 psia pipeline, the best packing occurs when the line is filled with pure methane. As ethane is added, the capacity gain percent decreases until there is about 25% ethane in the line. After this, the capacity gain begins to increase again, but it does not reach the levels obtained for pure methane.

Figure 1B:
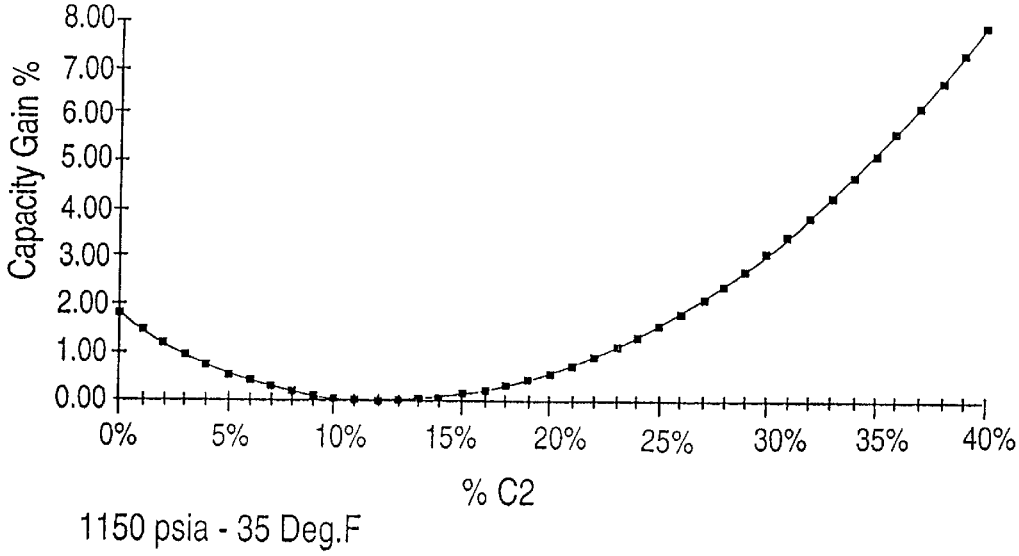

FIG. 1B shows the effect of addition to methane of ethane for a pipeline at 1,150 psia. Here, the capacity gain steadily decreases from 0% ethane to about 12% ethane, and then increases again. After approximately 25% ethane, the capacity gain is greater than occurred with no ethane at all.

Figure 1C:
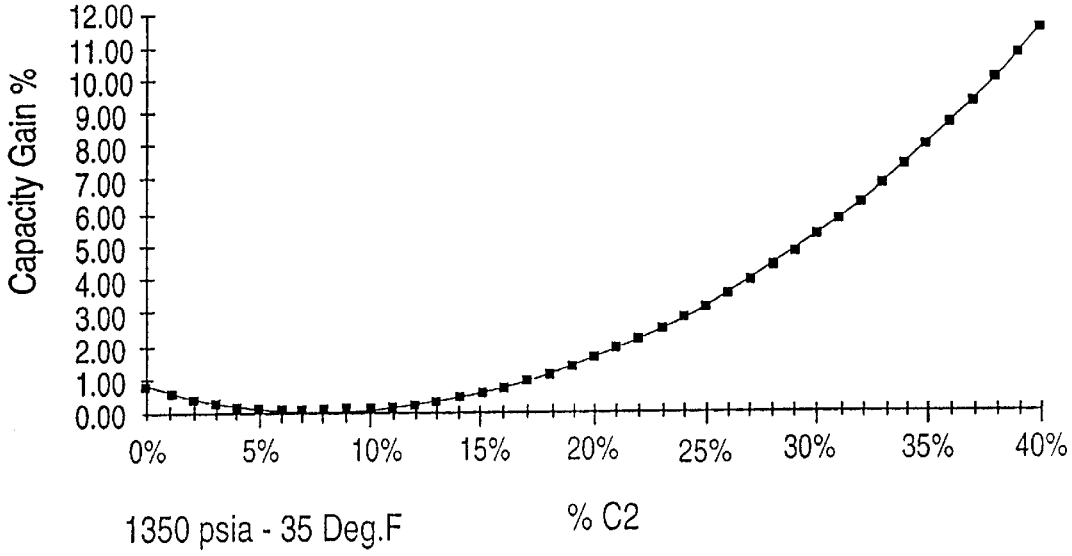

FIG. 1C shows that this effect is even more pronounced when the pipeline pressure is increased to 1,350 psia. The lowest capacity now occurs at approximately 7%, and mixtures with more than 17% ethane exhibit packing (and hence, pipeline or storage capacity) gains unattainable with of natural gas or methane alone.

Figure 1D:
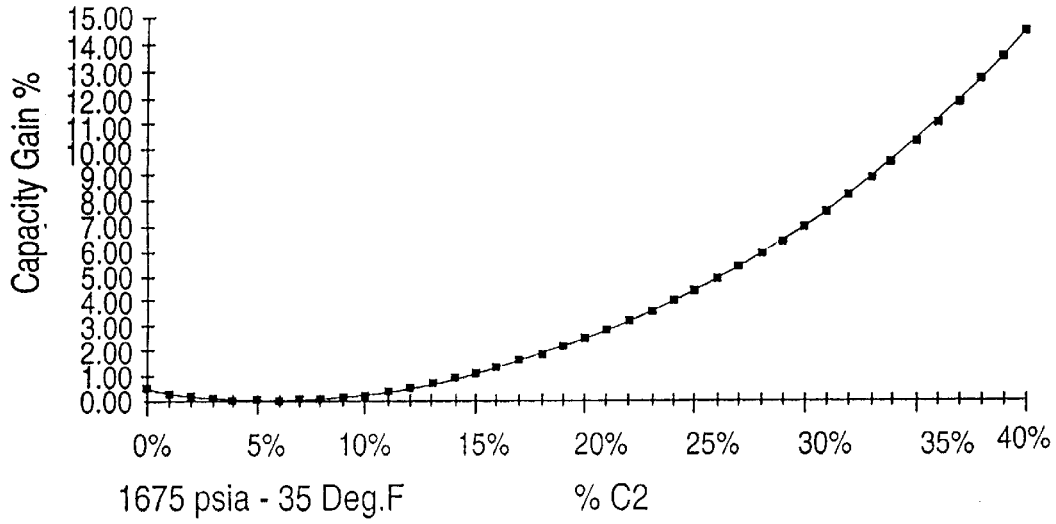
Figure 1E:
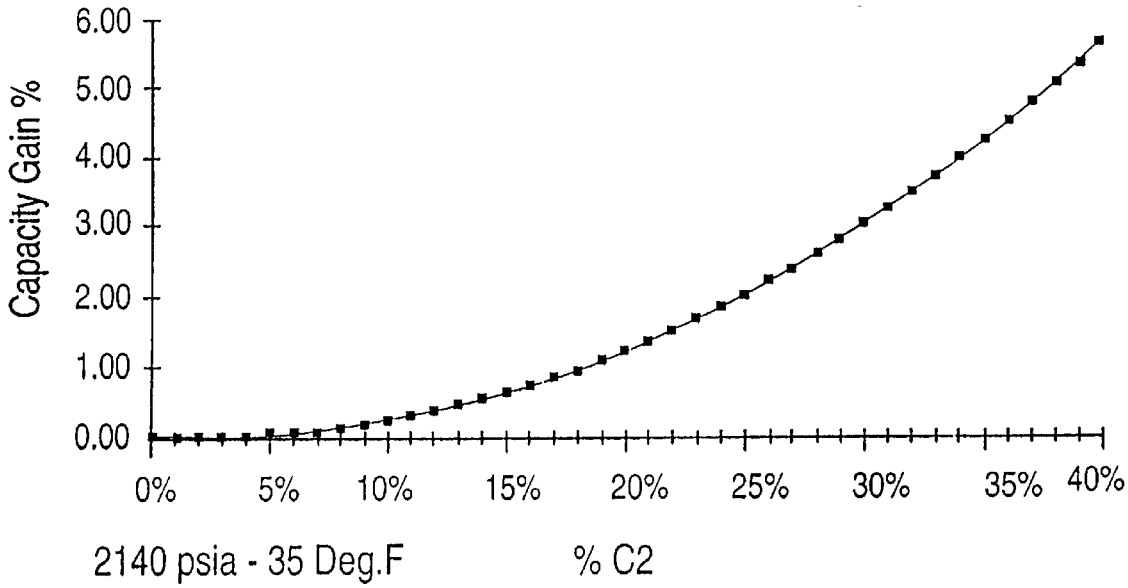

FIG. 1D shows that at 1,760 psia, the lowest capacity occurs at about 5%, and anything over 12% ethane gives a better capacity gain than is attainable with natural gas or methane alone. For best results, however, at least 15% ethane should be present.

At 2,140 psia (FIG. 1E) the addition of about 4% ethane gives a benefit, and the benefit steadily increases all the way up to the point at which the ethane begins to separate out in a liquid phase. For best results, however, at least 12% ethane, and preferably 15% ethane, should be present.

FIG. 1F shows the effect of the z factor and its product with the average molecular weight of the gas for gases having various amounts of methane and ethane (the ethane is shown in the table as "$C_2$") The flow ratio (1/the root of the $zM_w$ product) is plotted.

Thus, it will be seen that for pressures above about 1,000 psia better packing, and hence lower compression cost and pumping cost for transportation occurs when increased amounts of ethane are added over a minimum amount which decreases with increasing pressure. At 1,150 psia (FIG. 1B) about 24% ethane must be added to get the same packing effect as the approximately 2% ethane in normal natural gas. If more than this amount is added, however, better packing occurs with each addition. As the pressure increases, successively less ethane need be added to give better packing (and hence lower transmission costs and compression costs) than with natural gas. Indeed, at 2,410 psia, even about 4% ethane shows some advantage, although the advantage is of course greater as more ethane is added.

Figure 2A:
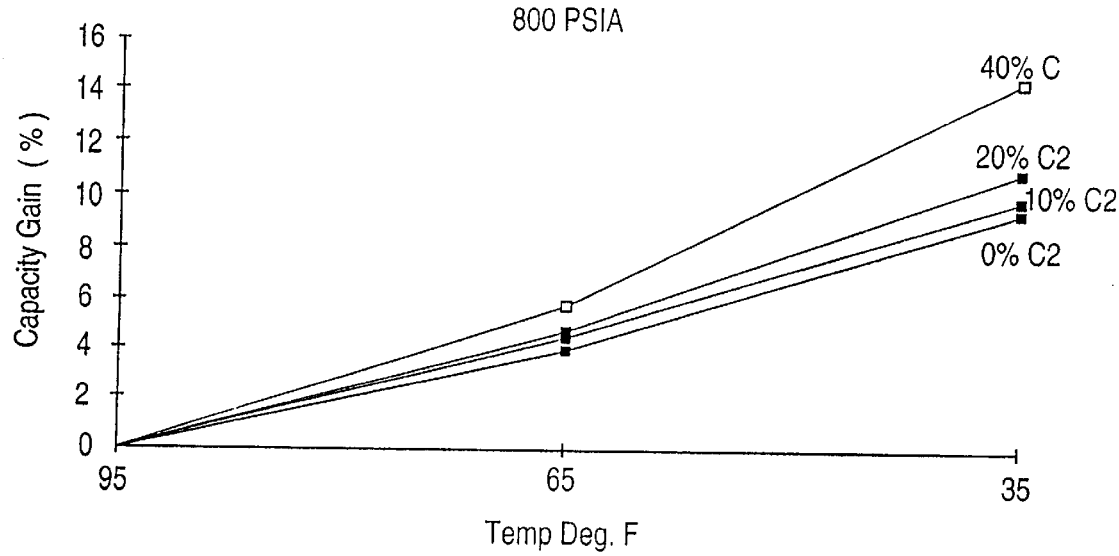
FIGS. 2A and 2B are plots of capacity gain versus temperature (in degrees Fahrenheit) for pipelines at 800 psia and 1,675 psia respectively.
Figure 2B:
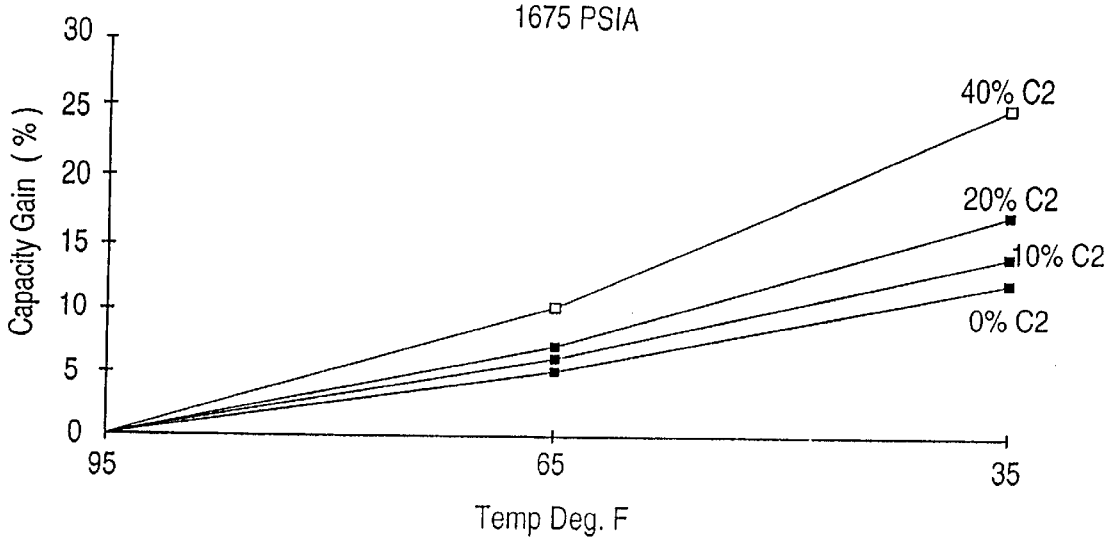

FIG. 2 shows how the effect changes with temperature. Even at 800 psia (FIG. 2A) there is a capacity increase (i.e. better packing) as temperature drops, and the capacity gain is greater the more $C_2$ that is present. However, the effect is not nearly as significant as at higher pressures. With higher pressure (FIG. 2B) the capacity gain is much greater with temperature, and the improvement in capacity gain becomes still greater as increased amounts of ethane are added. Generally, therefore, it is preferred to operate at a relatively low temperature, such as 70° to −20° F. Higher temperatures (e.g. up to about 120° F.) can be tolerated, but detract from the benefits of the invention.

FIG. 3 shows horsepower required for different gas mixes of ethane and methane, through a pipeline at a maximum pressure of 1,740 psia and a minimum pressure of 1,350 psia. Figures are for a pipeline of 36" in diameter and a length of 1,785 miles, with pumping stations located every 56 miles. At a throughput of 2.0 million, standard cubic feet per day, a mixture of 98% methane and 2% ethane (which corresponds to ordinary natural gas) would require 812,579 horsepower. However, the same standard volume of gas, but containing 35% $C_2$, can be moved with only 661,860 horsepower, for a saving of over 150,000 horsepower. When the throughput is raised to 2.5 million standard cubic feet, natural gas containing 2% ethane cannot practically be transmitted, because the velocities and temperatures involved are too great. However, gas with 6% ethane can be transmitted, and gas with 35% ethane shows a saving of over 500,000 horsepower over that which is used to transmit the gas with 6% ethane.

Figure 4:
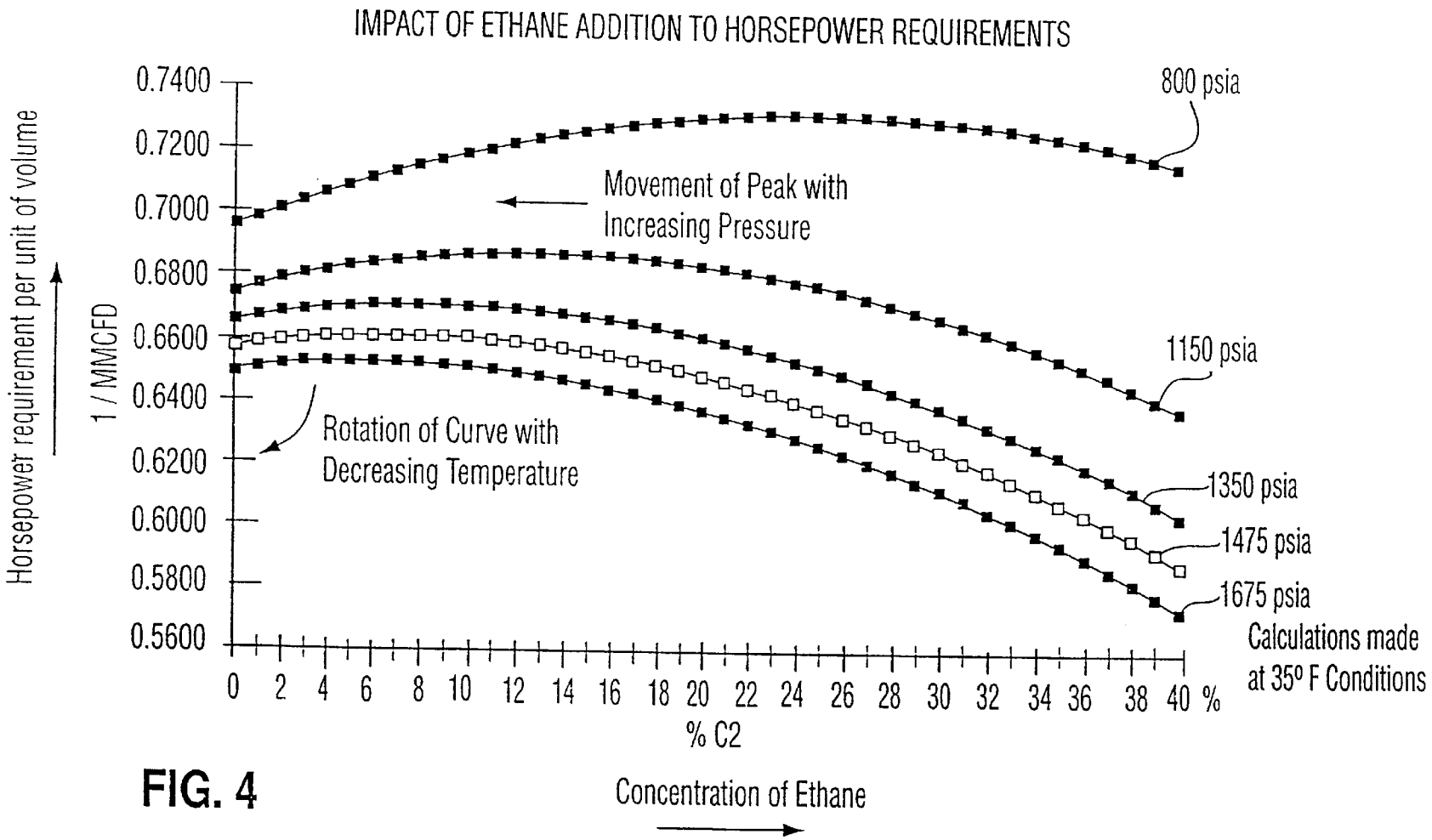
FIG. 4 is a plot of the horsepower requirements per thousand cubic feet of gas showing different mixtures of ethane and methane, at different pressures.

FIG. 4 shows the effect on horsepower requirements per million cubic feet of gas being pumped through the same pipeline as used in FIG. 3 when the pipeline gas contains different concentrations of ethane at 35° F.

FIG. 4 also shows the negative effect of adding ethane to a typical pipeline running at about 800 psia pressure and 35° F. Required power for pumping increases until the mix contains 26% ethane and then decreases for higher concentrations approaching the liquid phase limits. However, the decrease is not sufficient so that, by the concentration where liquefaction occurs (about 40%) there is any saving of horsepower over pumping ordinary natural gas. This energy hill however peaks at decreasing concentrations of ethane as operational pressure increases, e.g., 14% at 1,150 psia, 8% at 1,350 psia, 6% at 1,475 psia. This is due to the rate of decrease in the value of the z factor overcoming the rate of increase in density.

As noted, at 800 psia, increasing the amount of ethane even up to 40% of the mixture does not produce a saving of horsepower. At 1,150 psia, however, an increase of ethane to over about 24% causes a horsepower saving when compared to the values at 2% ethane (which is approximately the amount of ethane in most natural gas). At 1,350 psia, a decrease in horsepower occurs with mixtures containing more than about 14% ethane. As the pressure increases, the horsepower saving occurs with still less added ethane. As can be seen from FIG. 4, the peak horsepower requirement shifts to the left of the graph and becomes smaller as pressure increases. However, reading FIG. 4 with FIGS. 2A and 2B shows that, as temperature decreases, the curve tends to rotate to the right. Thus, as temperature decreases, less addition of ethane is necessary to obtain the desired additional packing and hence decreased compression and pumping energy requirements. The result is lower compressive power requirements for equivalent volumes of higher B.T.U. gas mixes than can be achieved with conventional pipeline specification natural gas. Higher pipeline throughput are able to be economically achieved with these enhanced gas mixes with corresponding increases in horsepower.

Similar effects are seen when ethylene is used in substitution for all or part of the ethane.

When propane, isopropane or propylene, or mixtures of any of these gases, are substituted for all or part of the ethane, the effects are even more pronounced than with ethane, and occur with a smaller addition of each of the compounds mentioned than was necessary with ethane as noted previously in this disclosure.

The preferred composition of the resulting gas is as follows:

| COMPONENT | MAXIMUM VALUE | MINIMUM VALUE |
|---|---|---|
| METHANE | 92% VOLUME | 68% VOLUME |
| ETHANE AND/Or ETHYLENE | 35% VOLUME | 6% VOLUME |
| PROPANE AND/OR OTHER $C_3$ | 12% VOLUME | 0% VOLUME |
| BUTANES AND OTHER COMPONENTS OF THE NATURAL GAS | Not required, but amount present in original natural gas (up to about 1%) can be tolerated if it does not cause separation of a liquid phase at the pressure and temperature used | 0% VOLUME |
| NITROGEN | Not required, but amount present in the original natural gas can be tolerated if below 2% by volume | 0% VOLUME |
| CARBON DIOXIDE | Not required, but amount present in the original natural gas can be tolerated if below 1% by volume. | 0% VOLUME |
| COMPONENTS TOTAL 100% | | |
| TEMPERATURE | 120° F. | −20° F. |
| PRESSURE | 2160 PSIA | 1150 PSIA |

Compositions with hydrocarbon additives outside these ranges generally are of little economic benefit, or approach the limits at which two-phase or liquid behaviour can be seen. Therefore, if mixtures outside these parameters are used, care should be taken to avoid conditions which might cause liquid to fall out of the mixture. Liquid is generally to be avoided, as it may pool in low areas of a pipeline and be difficult to remove. The preferential liquefaction of some components will also cause the composition of the gaseous phase of the mixture to change, thereby changing the z factor and hence the compressibility of the gaseous phase.

The foregoing has illustrated certain specific embodiments of the invention, but other embodiments will of course be evident to those skilled in the art. Therefore it is intended that the scope of the invention not be limited by the embodiments described, but rather by the scope of the appended claims.

What is claimed is:

1. A method of transporting natural gas by pipeline, which comprises:

(a) adding to such natural gas sufficient of at least one $C_2$ or $C_3$ hydrocarbon or a mixture of $C_2$ and $C_3$ hydrocarbons so the added hydrocarbon forms a resulting mixture with the natural gas having a total $C_2$ and $C_3$ hydrocarbon content which is sufficient, at the pressure and temperature to be used for transporting, to reduce the product of the z factor and the average molecular weight of the resulting mixture to a level lower than that of the untreated natural gas, and (b) transporting such resulting mixture by pipeline at a temperature of between −40° and +120° Fahrenheit and pressure of from 2160 psia to 1150 psia, said pressure and temperature being chosen so the resulting mixture has no liquid phase at the temperature and pressure of transmission.

2. A method as claimed in claim 1 where the hydrocarbon content of the resulting mixture is selected from (a) between 26 and 40% by volume of at least one $C_2$ compound if the pressure is about 1000 psia, varying in a continuously decreasing number to about 6% to 15% by volume of said $C_2$ compound if the pressure is about 2200 psia, and (b) between 12% and 4% of a $C_3$ compound by volume, if the pressure is about 1000 psia, varying in a continuously decreasing manner to the $C_3$ amount which will not cause liquefaction at the pressure used when the pressure is above 1000 psia.

3. A method as claimed in claim 1 in which there is not more than 1% by volume of carbon dioxide in the resulting mixture.

4. A method as claimed in claim 1, in which there is not more than 2% by volume of nitrogen in the resulting mixture.

5. A method as claimed in claim 1, in which the temperature at which the resulting mixture is transmitted is between −20° F. and +120° F.

6. A method as claimed in claim 1, in which the hydrocarbon added to the natural gas is ethane.

7. A method of transporting natural gas by pipeline, which comprises:

(a) adding to such natural gas sufficient propane to form a resulting mixture wherein at the pressure and temperature to be used for transporting, wherein the product of the z factor and the average molecular weight of the resulting mixture is lower than the product of the z factor and the average molecular weight of the untreated natural gas, and (b) transporting such resulting mixture by pipeline at a temperature of between −40° and +120° Fahrenheit and pressure greater than 1000 psia, said pressure and temperature being chosen so the resulting mixture has no liquid phase at the temperature and pressure of transmission.

* * * * *